US010240510B2

(12) United States Patent
Han et al.

(10) Patent No.: US 10,240,510 B2
(45) Date of Patent: Mar. 26, 2019

(54) STRUCTURE FOR COOLING EXHAUST MANIFOLD AND METHOD FOR CONTROLLING THE SAME

(71) Applicant: HYUNDAI MOTOR COMPANY, Seoul (KR)

(72) Inventors: Jong-Wan Han, Seoul (KR); Yong-Beom Park, Gunpo-Si (KR); Dang-Hee Park, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 76 days.

(21) Appl. No.: 15/342,425

(22) Filed: Nov. 3, 2016

(65) Prior Publication Data

US 2017/0268404 A1 Sep. 21, 2017

(30) Foreign Application Priority Data

Mar. 21, 2016 (KR) ..... 10-2016-0033320

(51) Int. Cl.
*F01P 1/06* (2006.01)
*F01N 13/10* (2010.01)
*F01P 5/06* (2006.01)

(52) U.S. Cl.
CPC ..... *F01P 1/06* (2013.01); *F01N 13/10* (2013.01); *F01P 5/06* (2013.01); *F01N 2260/022* (2013.01)

(58) Field of Classification Search
CPC .. F01N 13/10; F01N 13/102; F01N 2260/022; F01P 1/06; F01P 5/06
See application file for complete search history.

(56) References Cited

FOREIGN PATENT DOCUMENTS

| | | | |
|---|---|---|---|
| JP | H09-021316 | A | 1/1997 |
| JP | H09-280043 | A | 10/1997 |
| JP | 2010-025125 | A | 2/2010 |
| JP | 2010-132171 | A | 6/2010 |
| KR | 10-2004-0108466 | A | 12/2004 |
| KR | 10-2015-0017127 | A | 2/2015 |

OTHER PUBLICATIONS

Machine translation of JP 2010-132171 A, accessed Jun. 20, 2018.*
Machine translation of KR 2004-0108466 A, accessed Jun. 20, 2018.*

* cited by examiner

*Primary Examiner* — Jonathan Matthias
(74) *Attorney, Agent, or Firm* — Morgan Lewis & Bockius LLP

(57) ABSTRACT

A structure for cooling an exhaust manifold may include a duct cooling the exhaust manifold by using traveling wind or fan wind, a duct opening and closing portion mounted at a rear end of the duct for cooling an exhaust manifold to open or close the duct for cooling an exhaust manifold, and an exhaust manifold protector disposed at a lower end of the duct for cooling an exhaust manifold and enclosing the exhaust manifold.

10 Claims, 8 Drawing Sheets

STRUCTURE FOR COOLING EXHAUST MANIFOLD AND METHOD FOR CONTROLLING THE SAME

CROSS-REFERENCE TO RELATED APPLICATIONS

This application claims priority to the benefit of Korean Patent Application No. 10-2016-0033320, filed on Mar. 21, 2016, which is incorporated herein by reference in its entirety

TECHNICAL FIELD

The present disclosure relates to a structure for cooling an exhaust manifold and a method for controlling the same, and more particularly, to a structure for cooling an exhaust manifold and a method for controlling the same capable of cooling the exhaust manifold by a direct contact of traveling wind or fan wind with the exhaust manifold.

BACKGROUND

A vehicle has an exhaust manifold positioned at a front direction of the vehicle in which a cooling fan is positioned and an intake manifold positioned in a direction in which a dash panel dividing a driver's seat and an engine room is positioned. The intake manifold may be positioned at a rear side of the cooling fan and the exhaust manifold of the engine may be positioned in the direction of the dash panel.

Among those, the latter is called a reversing engine. In the case of the existing reversing engine as described above, the exhaust manifold is spaced apart from the cooling fan, and therefore the exhaust manifold is not sufficiently cooled. Describing it in more detail, the traveling wind or the fan wind introduced into the engine room may not be concentrated on the exhaust manifold.

According to a related art, the traveling wind or the fan wind may not directly contact the exhaust manifold by an exhaust manifold protector enclosing the exhaust manifold. Therefore, a cooling effect on the exhaust manifold is insignificant and a temperature of the exhaust manifold through which high-temperature exhaust gas passes and parts around the same is high, such that a thermal damage to the exhaust manifold and the parts around the same may occur, thereby reducing durability of the exhaust manifold and the parts around the same.

SUMMARY

An embodiment of the present disclosure is directed to a structure for cooling an exhaust manifold and a method for controlling the same capable of improving cooling efficiency of the exhaust manifold by directly supplying traveling wind or fan wind to the exhaust manifold.

Other objects and advantages of the present disclosure can be understood by the following description, and become apparent with reference to the embodiments of the present disclosure. In addition, it is obvious to those skilled in the art to which the present disclosure pertains that the objects and advantages of the present disclosure can be realized by the means as claimed and combinations thereof.

In accordance with an embodiment of the present disclosure, a structure for cooling an exhaust manifold includes: a duct cooling the exhaust manifold by using traveling wind or fan wind; a duct opening and closing portion mounted at a rear end of the duct for cooling an exhaust manifold to open or close the duct; and an exhaust manifold protector disposed at a lower end of the duct for cooling an exhaust manifold and enclosing the exhaust manifold.

The duct for cooling an exhaust manifold may be integrally formed with an engine cover.

A front end of the duct for cooling an exhaust manifold may be open toward a rear surface of a cooling fan.

A rear end of the duct for cooling an exhaust manifold may be open toward an upper surface of the exhaust manifold protector.

The duct for cooling an exhaust manifold may include a body portion into which traveling wind or fan wind is introduced; and the duct for cooling an exhaust manifold may include a hollow-shaped heat insulation portion having an upper end mounted at a rear end of the body portion and a lower end opened toward the upper surface of the exhaust manifold protector.

The duct opening and closing portion may include a variable inlet opening or closing the heat insulation portion; an actuator disposed at one side of the variable inlet to apply a rotating force to the variable inlet; and a link transferring the rotating force of the actuator to the variable inlet.

The variable inlet may include: a rotating shaft fastened with the link; a first side plate and a second side plate having a fan shape having the rotating shaft as a center and being vertically fastened with the rotating shaft to face each other; a blocking plate connecting facing sides of the first side plate and the second side plate to each other and closing the heat insulation portion; and a communication plate connecting the other facing sides of the first side plate and the second side plate to each other and having an inside formed with a through hole through which traveling wind or fan wind passes.

The exhaust manifold protector may include: a cooling hole formed on an upper surface thereof; and a guide portion protruding upwardly from an outer circumferential surface of the cooling hole.

A center of the cooling hole and a center of a lower end of the heat insulation portion may be disposed on the same line.

An upper end of the guide portion and a lower end of the heat insulation portion may be disposed to be spaced apart from each other as much as a preset length.

An upper end of the guide portion and a lower end of the heat insulation portion may be connected to each other.

In accordance with another embodiment of the present disclosure, a method for controlling a structure for controlling an exhaust manifold includes: a step of determining an opening condition of a duct for cooling an exhaust manifold; when an opening condition of the duct for cooling an exhaust manifold is satisfied, an opening control step of controlling a duct opening portion to open the duct for cooling an exhaust manifold or maintain the opened state; and after the opening control step, a step of cooling an exhaust manifold disposed inside an exhaust manifold protector by passing traveling wind or fan wind introduced through the duct for cooling an exhaust manifold through a cooling hole of the exhaust manifold protector.

The method may further include: a closing control step of controlling the duct opening portion to close the duct for cooling an exhaust manifold or maintain the closed state when the opening condition of the duct for cooling an exhaust manifold is not satisfied.

An opening condition of the duct for cooling an exhaust manifold may be a condition that a preset time exceeds after a start under a cold start condition.

The opening condition of the duct for cooling an exhaust manifold may be a condition that a surface temperature of the exhaust manifold exceeds a preset reference temperature.

DETAILED DESCRIPTION OF SPECIFIC EMBODIMENTS

Terms and words used in the present specification and claims are not to be construed as a general or dictionary meaning but are to be construed meaning and concepts meeting the technical ideas of the present disclosure based on a principle that the inventors can appropriately define the concepts of terms in order to describe their own inventions in best mode. Therefore, the configurations described in the exemplary embodiments and drawings of the present disclosure are merely examples but do not represent all of the technical spirit of the present disclosure. Thus, the present disclosure should be construed as including all the changes, equivalents, and substitutions included in the spirit and scope of the present disclosure at the time of filing this application. In the present specification, an overlapped description and a detailed description for well-known functions and configurations that may obscure the gist of the present invention will be omitted. Hereinafter, exemplary embodiments will be described in detail with reference to the accompanying drawings.

Figure 1:
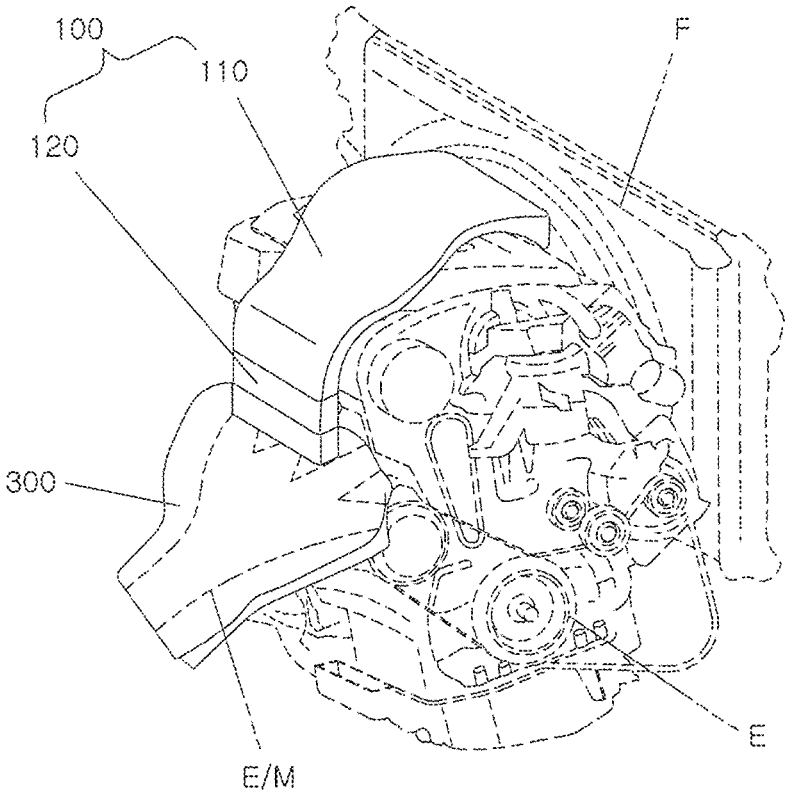
FIG. 1 is a perspective view of a structure for cooling an exhaust manifold according to an exemplary embodiment of the present disclosure.
Figure 2:
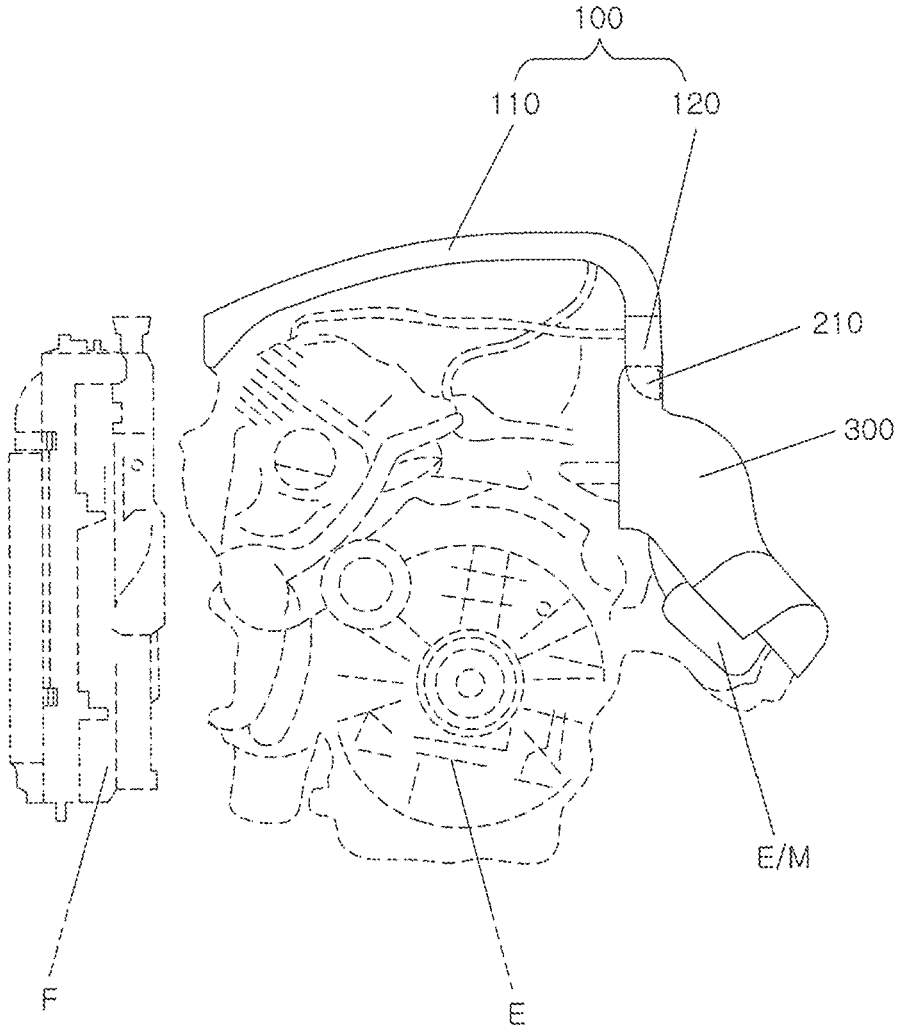
FIG. 2 is a side view of the structure for cooling an exhaust manifold according to the exemplary embodiment of the present disclosure.
Figure 3:
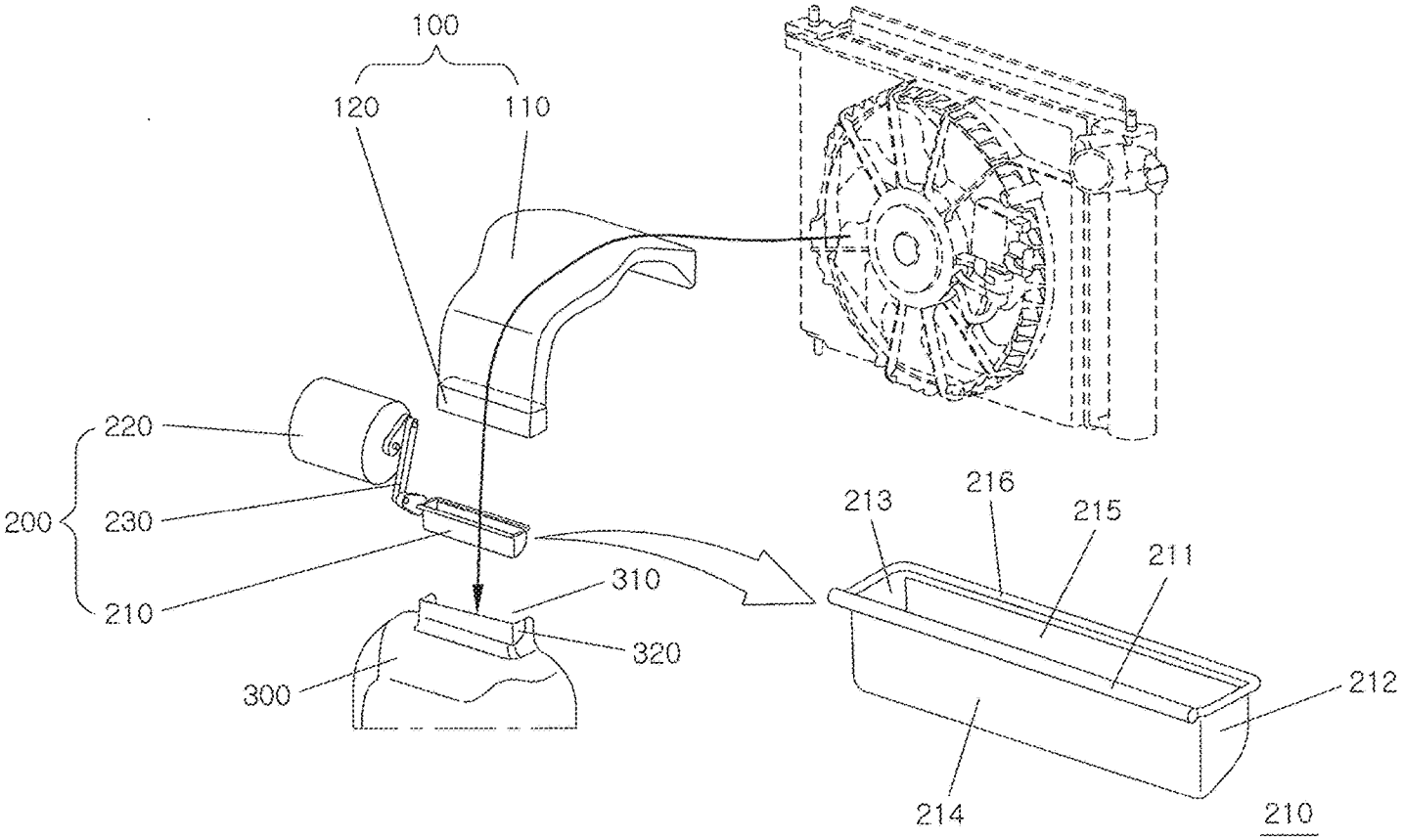
FIG. 3 is an exploded perspective view of the structure for cooling an exhaust manifold according to the exemplary embodiment of the present disclosure.
Figure 4:
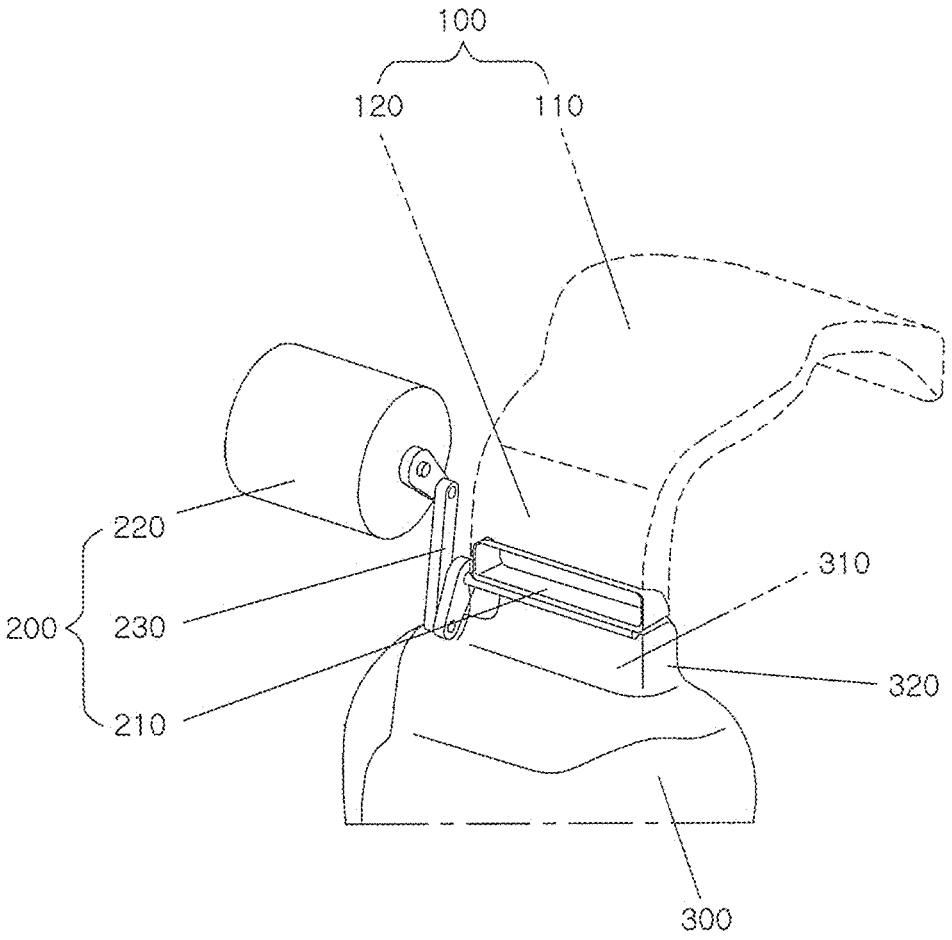
FIGS. 4 to 7 are operating state views of the structure for cooling an exhaust manifold according to the exemplary embodiment of the present disclosure.
Figure 5:
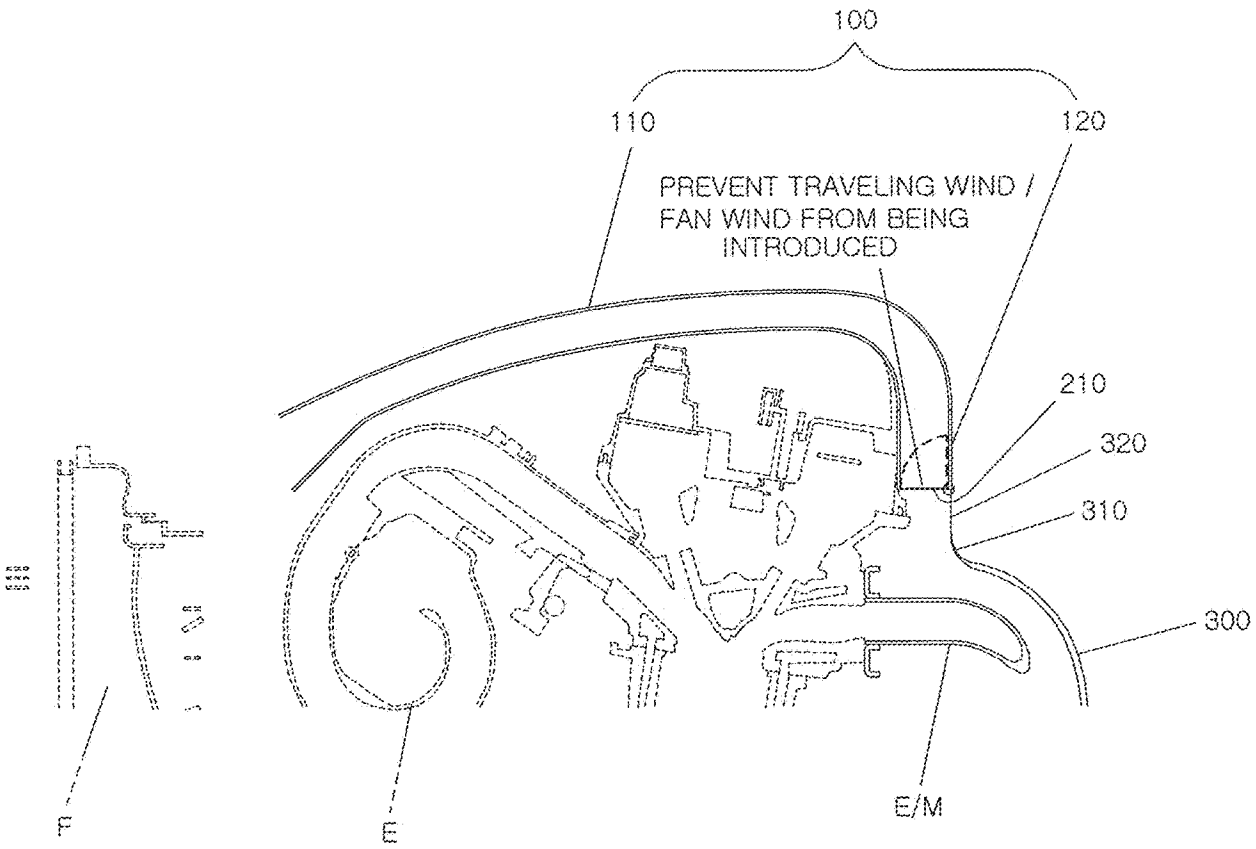
Figure 6:
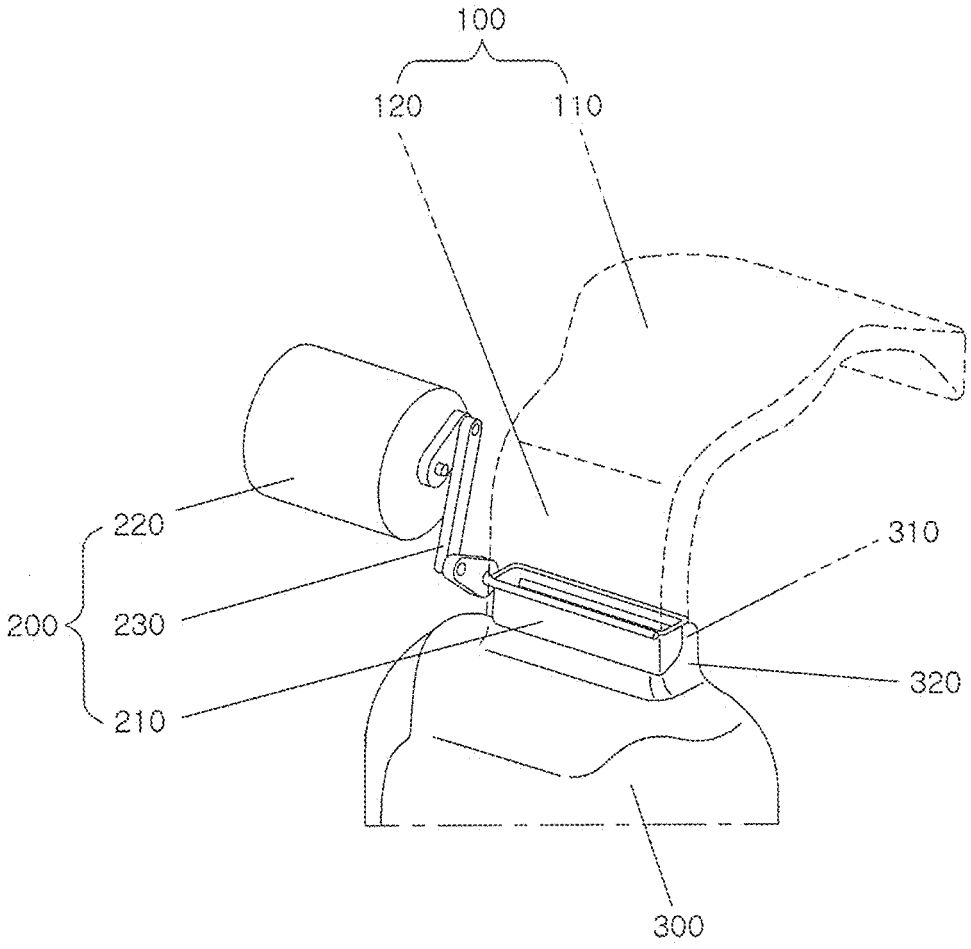
Figure 7:
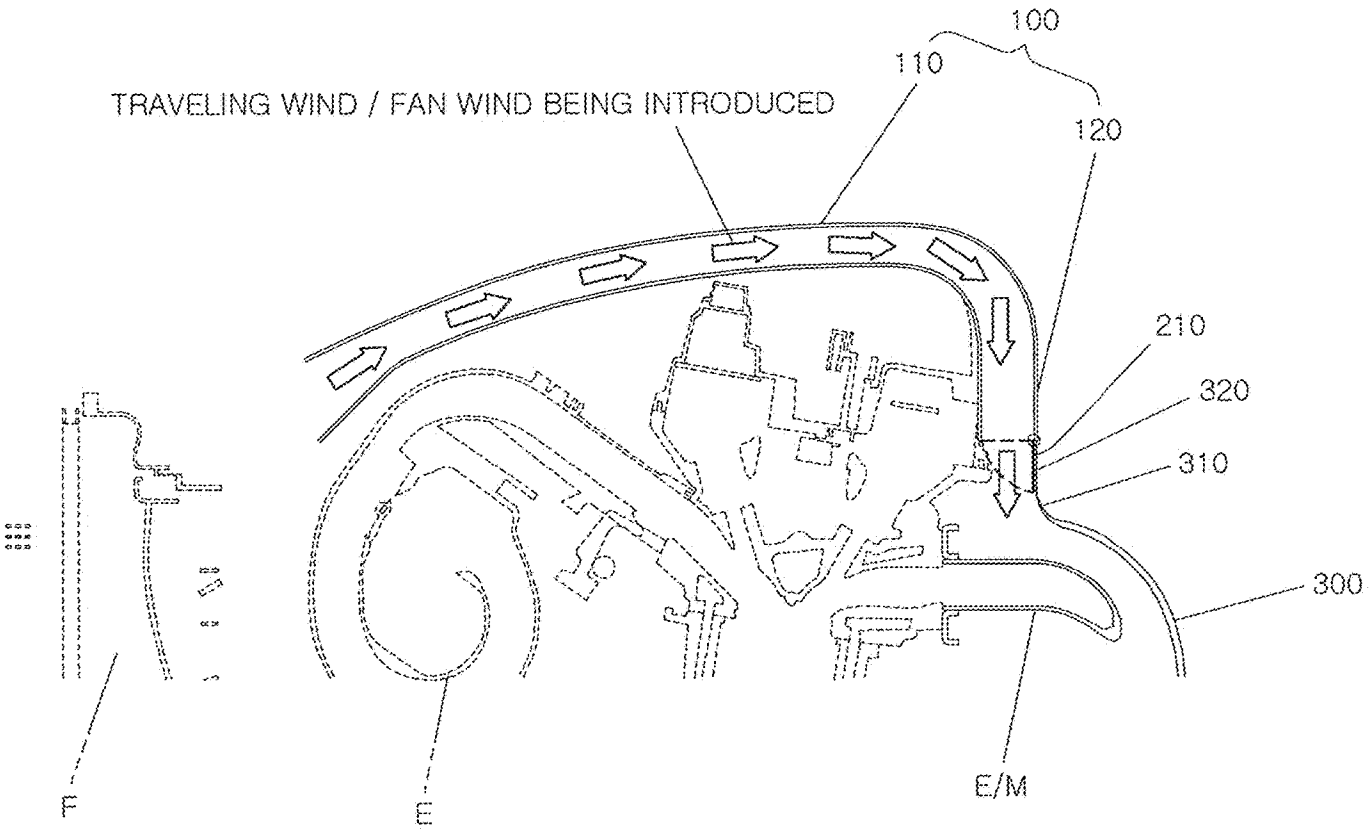

FIG. 1 is a perspective view of a structure for cooling an exhaust manifold according to an exemplary embodiment of the present disclosure, FIG. 2 is a side view of the structure for cooling an exhaust manifold according to the exemplary embodiment of the present disclosure, and FIG. 3 is an exploded perspective view of the structure for cooling an exhaust manifold according to the exemplary embodiment of the present disclosure. Referring to FIGS. 1 to 3, a structure for controlling an exhaust manifold according to the present disclosure includes a duct 100 for cooling an exhaust manifold, a duct opening and closing portion 200, and an exhaust manifold protector 300.

The duct 100 for cooling an exhaust manifold uses traveling wind or fan wind to serve to cool an exhaust manifold E/M. Describing this in more detail, the duct 100 for cooling an exhaust manifold may be integrally formed with an engine cover and a front end of the duct 100 for cooling an exhaust manifold may be opened toward a rear surface of a cooling fan F and a rear end of the duct 100 for cooling an exhaust manifold may be opened toward an upper surface of the exhaust manifold protector 300.

That is, the traveling wind or the fan wind introduced into the duct 100 for cooling an exhaust manifold through the front end of the duct 100 for cooling an exhaust manifold is discharged from the rear end of the duct 100 for cooling an exhaust manifold to the upper surface of the exhaust manifold protector 300. Next, the discharged traveling wind or fan wind is introduced into the exhaust manifold protector 300 through a cooling hole 310 to be described later to directly cool the exhaust manifold E/M.

In this case, the duct 100 for cooling an exhaust manifold includes a body portion 110 into which the traveling wind or the fan wind is introduced and a hollow-shaped heat insulation portion 120 having an upper end mounted at a rear end of the body portion 110 and a lower end opened toward the upper surface of the exhaust manifold protector 300. The exhaust manifold E/M and the exhaust manifold protector 300 are heated by high-temperature exhaust gas when the engine is driven. Therefore, the heat insulation portion 120 of a heat insulation material is disposed at a position near the exhaust manifold E/M and the exhaust manifold protector 300 in the duct 100 for cooling an exhaust manifold to prevent the duct 100 for cooling an exhaust manifold to be thermally damaged.

The duct opening and closing portion 200 is mounted at a rear end of the duct 100 for cooling an exhaust manifold to serve to open or close the duct 100 for cooling an exhaust manifold. Describing in more detail, the duct 100 for cooling an exhaust manifold is closed at the time of the cold start to minimize the discharge of heat in an engine room to the outside. The reason is that viscosity of oil, or the like in a power train is high under the cold start condition and therefore a friction force is increased to have an adverse effect on fuel efficiency. Further, the duct 100 for cooling an exhaust manifold is open under high speed driving and the high temperature condition in the engine room, and as a result the cooling of the exhaust manifold E/M is maximized. This is to prevent the exhaust manifold E/M and parts around the same from being thermally damaged due to the exhaust manifold through which the high-temperature exhaust gas passes and the parts around the same, thereby preventing durability of the exhaust manifold and the parts around the same from being reduced.

The duct opening and closing portion 200 includes a variable inlet 210, an actuator 220, and a link 230. The variable inlet 210 serves to open or close the heat insulation portion 120, in which a detailed structure of the variable inlet 210 will be described below. The actuator 220 is disposed at one side of the variable inlet 210 to serve to apply a rotating force to the variable inlet 210. Further, the link 230 serves to transfer a rotating force of the actuator 220 to the variable inlet 210. That is, the rotating force generated from the actuator 220 is transferred to the variable inlet 210 through the link 230, and as a result, the variable inlet 210 opens or closes the duct 100 for cooling an exhaust manifold, in more detail, the heat insulation portion 120.

In this case, the variable inlet 210 includes a rotating shaft 211, a first side plate 212, a second side plate 213, a blocking plate 214, and a communication plate 216. The rotating shaft 211 is fastened with the link 230, such that it may be rotated by the rotating force generated from the actuator 220.

The first side plate 212 and the second side plate 213 have a fan shape having the rotating shaft 211 as a center and are vertically fastened with the rotating shaft 211 to face each other.

The blocking plate 214 connects facing sides of the first side plate 212 and the second side plate 213 to each other and becomes a surface closing the heat insulation portion 120 and the communication plate 216 connects the other facing sides of the first side plate 212 and the second side plate 213 to each other and an inside thereof is provided with a through hole 215 through which traveling wind or fan wind may pass and thus becomes a surface opening the heat insulation portion 120.

Describing in more detail, when the duct 100 for cooling an exhaust manifold is closed, the blocking plate 214 is vertically disposed inside the heat insulation portion 120 to close the inside of the heat insulation portion 120. Therefore, the traveling wind or the fan wind introduced into the duct 100 for cooling an exhaust manifold is not discharged to the exhaust manifold E/M.

On the contrary, when the duct 100 for cooling an exhaust manifold is open, the communication plate 216 is vertically disposed inside the heat insulation portion 120. In this case, the traveling wind or the fan wind introduced into the duct 100 for cooling an exhaust manifold through the through hole 215 formed inside the communication plate 216 is discharged to the exhaust manifold E/M to directly cool the exhaust manifold E/M.

The exhaust manifold protector 300 is disposed at a lower end of the duct 100 for cooling an exhaust manifold and is formed to enclose the exhaust manifold E/M. That is, the exhaust manifold protector 300 prevents heat generated from the exhaust manifold E/M from being discharged into the engine room.

The exhaust manifold protector 300 includes a cooling hole 310 formed on an upper surface thereof and a guide portion 320 protruding upwardly from an outer circumferential surface of the cooling hole 310. That is, the traveling wind or the fan wind discharged from the duct 100 for cooling an exhaust manifold, in more detail, the heat insulation portion 120 is introduced into the exhaust manifold protector 300 through the cooling hole 310 to directly cool the exhaust manifold E/M. Further, the guide portion 320 serves to guide a path through which the traveling wind or the fan wind as described above is introduced into the exhaust manifold protector 300.

In this case, a center of the cooling hole 310 and a center of a lower end of the heat insulation portion 120 are disposed on the same line. This is to increase an introduction ratio of the traveling wind or the fan wind discharged from the heat insulation portion 120 into the exhaust manifold protector 300.

Further, the upper end of the guide portion 320 and the lower end of the heat insulation portion 120 may also be disposed to be spaced apart from each other as much as a preset length. As described above, the exhaust manifold E/M and the exhaust manifold protector 300 are heated upon the driving of the engine and thus becomes high temperature. Therefore, even the heat insulation portion 120 of a heat insulation material is likely to be thermally damaged due to heat conductivity by the exhaust manifold protector 300, and therefore an upper end of the guide portion 320 and the lower end of the heat insulation portion 120 may be disposed to be spaced apart from each other as much as a preset length. In this case, the preset length may be differently set according to a designer's intention, or the like.

Further, the upper end of the guide portion 320 and the lower end of the heat insulation portion 120 may also be connected to each other. As described above, the introduction amount of the traveling wind or the fan wind discharged from the heat insulation portion 120 into the exhaust manifold protector 300 is maximized to increase the cooling efficiency of the exhaust manifold E/M. In this case, the material of the heat insulation portion 120 may be a material that may put up with higher temperature than the material of the heat insulation portion 120 disposed to be spaced apart from the guide portion 320.

The analysis result of the effect of the structure for cooling an exhaust manifold as described above is as the following Table 1.

TABLE 1

| | Vehicle velocity (km/h) | Surface temperature of exhaust manifold (° C.) | Temperature of step bar bush (° C.) | Aerodynamic |
|---|---|---|---|---|
| Related Art | 50 km/h | 440.88 | 202.64 | 264 |
| | 100 km/h | 310.35 | 134.74 | 264 |
| The invention | 50 km/h | 366.69(−38.87) | 193.27(−9.37) | 266 |
| | 100 km/h | 250.49(−59.86) | 127.58(−7.16) | 264 |

As shown in the above Table 1, compared to the related art, the surface temperature of the exhaust manifold of the vehicle to which the present invention is applied was reduced to 38.87° C. at 50 km/h and 59.86° C. at 100 km/h. Therefore, compared to the related art, the temperature of the step bar bush which is one of parts in the engine room of the vehicle to which the present disclosure is applied was also reduced to 9.37° C. at 50 km/h and 7.16° C. at 100 km/h. That is, due to the application of the present disclosure, the temperature of the exhaust manifold is reduced, and therefore, it is confirmed that the thermal damage of the parts in the engine room may be prevented.

Figure 8:
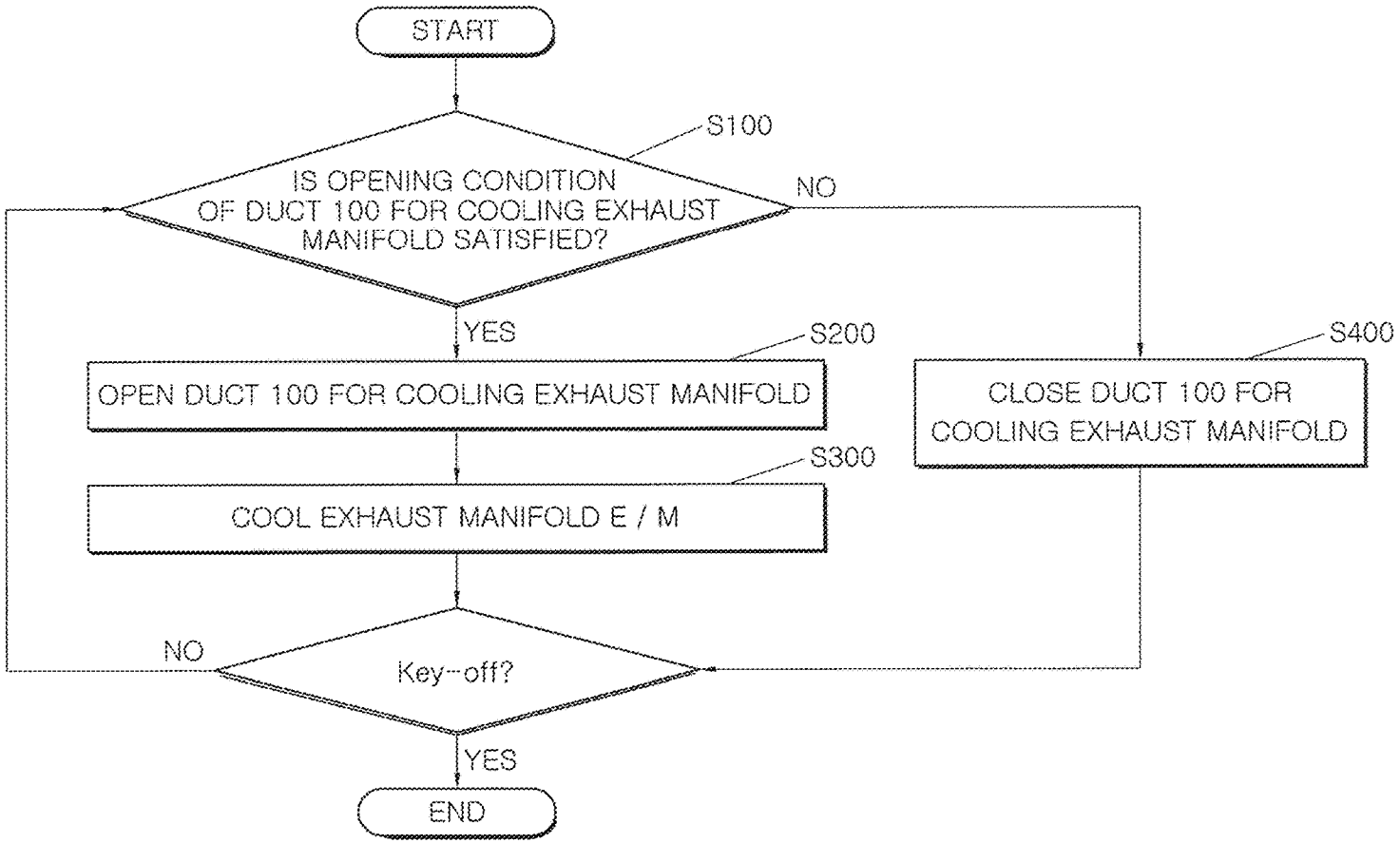
FIG. 8 is a flow chart of a method for controlling a structure for cooling an exhaust manifold according to an exemplary embodiment of the present disclosure.

FIGS. 4 to 7 are operating state views of the structure for cooling an exhaust manifold according to an exemplary embodiment of the present disclosure, and FIG. 8 is a flow chart of a method for controlling the structure for cooling an exhaust manifold according to an exemplary embodiment of the present disclosure. Referring to FIGS. 4 to 8, the method for controlling a structure for controlling an exhaust manifold according to an exemplary embodiment of the present disclosure includes: a step (S100) of determining an opening condition of the duct 100 for cooling an exhaust manifold; when the opening condition of the duct 100 for cooling an exhaust manifold is satisfied, an opening control step (S200) of controlling the duct opening portion 200 to open the duct 100 for cooling an exhaust manifold or maintain an opened state; and after the opening control step (S200), a step (S300) of cooling the exhaust manifold E/M disposed inside the exhaust manifold protector 300 by passing the traveling wind or the fan wind introduced through the duct 100 for cooling an exhaust manifold through the cooling hole 310 of the exhaust manifold protector 300.

For example, the duct 100 for cooling an exhaust manifold is closed at the time of the cold start to minimize the discharge of heat in the engine room to the outside (S100 to S300). The reason is that viscosity of oil, or the like in a power train is high under the cold start condition and therefore a friction force is increased to have an adverse effect on fuel efficiency.

Further, the method for controlling a structure for cooling an exhaust manifold includes a closing control step of controlling the duct opening portion 200 to close the duct 100 for cooling an exhaust manifold or maintain the closed state when the opening condition of the duct 100 for cooling an exhaust manifold is not satisfied (S400).

For example, the duct 100 for cooling an exhaust manifold is open under high speed driving and the high temperature condition in the engine room, and as a result the cooling of the exhaust manifold (E/M) is maximized. This is to prevent the exhaust manifold (E/M) and parts around the same from being thermally damaged due to the exhaust manifold through which the high-temperature exhaust gas passes and the parts around the same, thereby preventing the durability of the exhaust manifold and the parts around the same from being reduced.

The opening condition of the duct 100 for cooling an exhaust manifold may be a condition that a elapse time after the start exceeds a preset time under the cold start condition and the opening condition of the duct 100 for cooling an exhaust manifold may be a condition that the surface temperature of the exhaust manifold E/M exceeds a preset reference temperature, but is not necessarily limited to the above-mentioned condition and therefore may also be set to be other conditions according to the designer's intention, or the like. In particular, when a start stops after the vehicle is driven, the temperature of the exhaust manifold E/M may suddenly rise due to the reduction in the traveling wind, and therefore it may sufficiently cool the same.

As described above, according to the present disclosure, the discharge of heat in the engine room to the outside may be minimized at the time of the cold start to reduce the friction force of oil in the power train, thereby improving the fuel efficiency.

Further, the exhaust manifold E/M may be cooled by the direct contact of the traveling wind or the fan wind with the exhaust manifold E/M under the high-speed traveling and the high temperature condition in the engine room to prevent the thermal damage to the exhaust manifold E/M and the parts around the same from occurring and the durability of the exhaust manifold and the parts from being reduced.

The foregoing exemplary embodiments are only examples to allow a person having ordinary skill in the art to which the present disclosure pertains (hereinafter, referred to as those skilled in the art) to easily practice the present disclosure. Accordingly, the present disclosure is not limited to the foregoing exemplary embodiments and the accompanying drawings, and therefore, a scope of the present disclosure is not limited to the foregoing exemplary embodiments. Accordingly, it will be apparent to those skilled in the art that substitutions, modifications, and variations can be made without departing from the spirit and scope of the invention as defined by the appended claims and can also belong to the scope of the invention.

What is claimed is:

1. A structure for cooling an exhaust manifold, comprising:

a duct cooling the exhaust manifold by using traveling wind or fan wind;

a duct opening and closing portion mounted at a rear end of the duct to open or close the duct for cooling an exhaust manifold; and an exhaust manifold protector disposed at a lower end of the duct for cooling the exhaust manifold and enclosing the exhaust manifold, wherein the duct includes:

a body portion into which the traveling wind or fan wind is introduced; and a hollow-shaped heat insulation portion having an upper end mounted at a rear end of the body portion and a lower end opened toward an upper surface of the exhaust manifold protector, wherein the exhaust manifold protector includes:

a cooling hole formed on an upper surface of the exhaust manifold; and a guide portion protruding upwardly from an outer circumferential surface of the cooling hole, wherein an upper end of the guide portion and the lower end of the heat insulation portion are connected to each other.

2. The structure of claim 1, wherein the duct is integrally formed with an engine cover.

3. The structure of claim 1, wherein a front end of the duct is open toward a rear surface of a cooling fan.

4. The structure of claim 1, wherein the duct opening and closing portion includes a variable inlet opening or closing the heat insulation portion.

5. The structure of claim 4, wherein the duct opening and closing portion includes an actuator disposed at one side of the variable inlet to apply a rotating force to the variable inlet.

6. The structure of claim 5, wherein the duct opening and closing portion includes a link transferring the rotating force of the actuator to the variable inlet.

7. The structure of claim 6, wherein the variable inlet includes:

a rotating shaft fastened with the link; and a first side plate and a second side plate having a fan shape having the rotating shaft as a center and being vertically fastened with the rotating shaft to face each other.

8. The structure of claim 7, wherein the variable inlet includes a blocking plate connecting facing sides of the first side plate and the second side plate to each other and closing the heat insulation portion.

9. The structure of claim 7, wherein the variable inlet includes a communication plate connecting the other facing sides of the first side plate and the second side plate to each other and having an inside formed with a through hole through which the traveling wind or fan wind passes.

10. The structure of claim 1, wherein a center of the cooling hole and a center of the lower end of the heat insulation portion are disposed on the same line.

* * * * *